US010612777B2

(12) United States Patent
Kaneko

(10) Patent No.: US 10,612,777 B2
(45) Date of Patent: Apr. 7, 2020

(54) DRY DISTILLATION GASIFICATION WASTE INCINERATION METHOD

(71) Applicant: KINSEI SANGYO CO., LTD., Takasaki-shi, Gunma (JP)

(72) Inventor: Masamoto Kaneko, Gunma (JP)

(73) Assignee: KINSEI SANGYO CO., LTD., Takasaki-Shi (JP)

( * ) Notice: Subject to any disclaimer, the term of this patent is extended or adjusted under 35 U.S.C. 154(b) by 83 days.

(21) Appl. No.: 16/072,980

(22) PCT Filed: Jan. 27, 2017

(86) PCT No.: PCT/JP2017/002930
§ 371 (c)(1),
(2) Date: Jul. 26, 2018

(87) PCT Pub. No.: WO2017/131158
PCT Pub. Date: Aug. 3, 2017

(65) Prior Publication Data

US 2019/0032917 A1 Jan. 31, 2019

(30) Foreign Application Priority Data

Jan. 29, 2016 (WO) ..... PCT/JP2016/052725

(51) Int. Cl.
*F23G 5/04* (2006.01)
*F23G 5/027* (2006.01)
(Continued)

(52) U.S. Cl.
CPC ..... *F23G 5/04* (2013.01); *C10J 3/02* (2013.01); *C10J 3/721* (2013.01); *C10J 3/723* (2013.01);
(Continued)

(58) Field of Classification Search
CPC ..... F23G 5/04; F23G 5/50; F23G 5/16; F23G 5/027; F23G 2202/103; F23G 2201/303;
(Continued)

(56) References Cited

U.S. PATENT DOCUMENTS 4,913,069 A * 4/1990 Schultz ..... F23G 5/0276 110/185
5,313,894 A * 5/1994 Ishikawa ..... F23G 5/008 110/210
(Continued)

FOREIGN PATENT DOCUMENTS

JP H02-135280 5/1990
JP H08-94043 4/1996
(Continued)

OTHER PUBLICATIONS

International Search Report, dated Mar. 21, 2017 (Mar. 21, 2017), 2 pages.

*Primary Examiner* — David J Laux
(74) *Attorney, Agent, or Firm* — Rankin, Hill & Clark LLP

(57) ABSTRACT

A plurality of dry distillation furnaces (2*a*), (2*b*) are provided for a single combustion furnace (4). When wastes (A) in the dry distillation furnace (2*a*) are subjected to dry distillation to produce a combustible gas and introduce the combustible gas into the combustion furnace (4) to burn, control is carried out such that a temperature (Tc) in the combustion furnace (4) becomes a first temperature. When the temperature (Tc) in the combustion furnace (4) is the first temperature, the presence of the wastes (A) in the dry distillation furnace (2*b*) is detected, the wastes (A) in the dry distillation furnace (2*b*) are ignited to subject the wastes (A) to dry distillation thereby to produce a combustible gas, and the introduction of the combustible gas into the combustion furnace (4) is started.

5 Claims, 4 Drawing Sheets

(51) Int. Cl.

| | |
|---|---|
| ***F23G 5/16*** | (2006.01) |
| ***F23G 5/50*** | (2006.01) |
| ***C10J 3/72*** | (2006.01) |
| ***C10J 3/02*** | (2006.01) |

(52) U.S. Cl.
CPC ..... *F23G 5/027* (2013.01); *F23G 5/16* (2013.01); *F23G 5/50* (2013.01); *C10J 2300/0946* (2013.01); *C10J 2300/0959* (2013.01); *F23G 2201/303* (2013.01); *F23G 2202/103* (2013.01); *F23G 2207/101* (2013.01); *F23G 2207/30* (2013.01)

(58) Field of Classification Search
CPC .. F23G 2207/30; F23G 2207/101; C10J 3/02; C10J 3/721; C10J 3/723; C10J 2300/0959; C10J 2300/0946
See application file for complete search history.

(56) References Cited

U.S. PATENT DOCUMENTS

| | | | | |
|---|---|---|---|---|
| 5,619,938 | A * | 4/1997 | Kaneko ..... | F23G 5/027 110/346 |
| 2004/0103831 | A1 | 6/2004 | Pope | |

FOREIGN PATENT DOCUMENTS

| | | |
|---|---|---|
| JP | H09-14623 | 1/1997 |
| JP | 2005-009830 | 1/2005 |
| JP | 2005-345078 | 12/2005 |
| JP | 4050189 | 12/2007 |
| WO | 2006/117855 | 11/2006 |

* cited by examiner

DRY DISTILLATION GASIFICATION WASTE INCINERATION METHOD

TECHNICAL FIELD

The present invention relates to a method for dry-distilling and incinerating wastes, such as waste tires.

BACKGROUND ART

As a method for incinerating wastes, such as waste tires, there has been known, for example, a method in which a part of wastes held in a dry distillation furnace is burnt, the remainder of the wastes is subjected to dry distillation (pyrolysis) by the combustion heat, and the combustible gas produced by the dry distillation is introduced from the dry distillation furnace into a combustion furnace to burn the combustible gas (refer to, for example, Patent Literature 1).

According to the method described in Patent Literature 1, the temperature in the combustion furnace due to the combustion of the combustible gas is detected as the combustion temperature of the combustible gas. Further, the amount of oxygen to be supplied to the dry distillation furnace is regulated to feedback-control the dry distillation gasification of the wastes in the dry distillation furnace such that the temperature in the combustion furnace becomes a predetermined temperature (hereinafter may be abbreviated to "the set temperature"), i.e. such that the combustible gas is burnt at the set temperature. Here, the amount of oxygen to be supplied to the dry distillation furnace is controlled by adjusting the degree of opening of a valve provided in an oxygen supply passage that connects an oxygen supply source and the dry distillation furnace.

Further, the foregoing incineration method is based on batch processing. Hence, there has been known a method in which, for example, two such dry distillation furnaces are provided for one such combustion furnace, and the two dry distillation furnaces are alternately operated so as to perform continuous processing (refer to, for example, Patent Literature 2).

According to the method described in Patent Literature 2, when alternately operating the two dry distillation furnaces, the wastes in a second dry distillation furnace are ignited to start dry distillation in the final stage of the dry distillation of the wastes in a first dry distillation furnace. Then, a combustible gas to be burnt in the combustion furnace is switched from a combustible gas produced in the first dry distillation furnace to a combustible gas produced in the second dry distillation furnace.

CITATION LIST

Patent Literature

Patent Literature 1: Japanese Patent: Application Laid-Open No. 2-13580

Patent Literature 2: Japanese Patent No. 4050189

SUMMARY OF INVENTION

Technical Problem

However, when switching the combustible gas to be burnt in the combustion furnace from the combustible gas produced in one dry distillation furnace to the combustible gas produced in the other dry distillation furnace, if the switching does not smoothly proceed, the temperature in the foregoing combustion furnace becomes significantly lower than the set temperature in some cases. If this happens, it is required to burn a fuel, such as a heavy oil, to maintain the temperature in the combustion furnace at the predetermined temperature, inconveniently making an increase in running cost unavoidable.

An object of the present invention is to provide a dry distillation gasification waste incineration method that resolves such an inconvenience and enables a reduction in running cost for switching a combustible gas to be burnt in the combustion furnace from a combustible gas produced in one dry distillation furnace to a combustible gas produced in the other dry distillation furnace.

Solution to Problem

To this end, a dry distillation gasification waste incineration method in accordance with the present invention is a dry distillation gasification waste incineration method in which a plurality of dry distillation furnaces are provided for one combustion furnace, wastes held in each of the dry distillation furnaces are dry-distilled in sequence thereby to produce a combustible gas, and control is carried out such that a temperature in the combustion furnace becomes a predetermined first temperature in a case where the combustible gas is introduced into the combustion furnace and burnt, the method including: a step of supplying oxygen required for the dry distillation of the wastes to a first dry distillation furnace while controlling a degree of opening of a first valve provided in a first oxygen supply passage such that the temperature in the combustion furnace becomes a first temperature by the combustion of the combustible gas in the case where the combustible gas is produced by dry-distilling wastes held in the first dry distillation furnace by using the oxygen supplied to the first dry distillation furnace through the first oxygen supply passage from an oxygen supply source and the combustible gas is introduced into the combustion furnace and burnt; a step of detecting presence of wastes in a second dry distillation furnace while control is being carried out such that the temperature in the combustion furnace becomes the first temperature by the combustion of the combustible gas produced in the first dry distillation furnace and then igniting the wastes held in the second dry distillation furnace by using oxygen supplied to the second dry distillation furnace through a second oxygen supply passage from the oxygen supply source; and a step of dry-distilling the wastes held in the second dry distillation furnace by using oxygen supplied to the second dry distillation furnace through the second oxygen supply passage from the oxygen supply source so as to produce a combustible gas and introducing the combustible gas produced in the second dry distillation furnace into the combustion furnace to start combustion.

In the dry distillation gasification waste incineration method according to the present invention, first, a combustible gas is produced in the first dry distillation furnace by dry-distilling wastes held in a furnace by using oxygen supplied to the first dry distillation furnace through the first oxygen supply passage from the oxygen supply source. Further, when the combustible gas is introduced into the combustion furnace and burnt, the oxygen required for dry-distilling the wastes is supplied to the first dry distillation furnace while controlling the degree of opening of the first valve provided in the first oxygen supply passage.

Here, the degree of opening of the first valve is controlled such that the temperature in the combustion furnace becomes a predetermined first temperature by the combustion of the combustible gas, which has been produced in the first dry distillation furnace, in the combustion furnace. In other words, the degree of opening of the first valve is controlled such that the combustible gas produced in the first dry distillation furnace is burnt at the predetermined first temperature in the combustion furnace.

Next, while the control is being carried out such that the temperature in the combustion furnace becomes the first temperature by the combustion of the combustible gas, which has been produced in the first dry distillation furnace, in the combustion furnace, the presence of the wastes held in the second dry distillation furnace is detected and the wastes held in the second dry distillation furnace are ignited. The wastes held in the second dry distillation furnace are ignited using the oxygen supplied to the second dry distillation furnace through the second oxygen supply passage from the oxygen supply source.

Subsequently, after the wastes held in the second dry distillation furnace are ignited, the wastes are subjected to dry distillation by using the oxygen supplied to the second dry distillation furnace through the second oxygen supply passage from the oxygen supply source. Then, the combustible gas produced by the dry distillation is introduced into the combustion furnace and the combustion is started, thereby enabling smooth switching of the combustible gas to be burnt in the combustion furnace from the combustible gas produced in the first dry distillation furnace to the combustible gas produced in the second dry distillation furnace.

In the dry distillation gasification waste incineration method in accordance with the present invention, while the control is being carried out such that the temperature in the combustion furnace becomes the first temperature, the wastes held in the second dry distillation furnace are ignited, the combustible gas produced in the second dry distillation furnace is introduced into the combustion furnace, and the combustion is begun without waiting for the dry distillation of the wastes in the first dry distillation furnace to reach the final stage, as in the foregoing prior art. Hence, in the dry distillation gasification waste incineration method in accordance with the present invention, the temperature in the combustion furnace does not fall significantly below the predetermined first temperature and it is not required to burn a fuel, such as a heavy oil, to maintain the temperature in the combustion furnace at the predetermined temperature, thus enabling a reduction in running cost.

In the dry distillation gasification waste incineration method according to the present invention, when introducing and burning the combustible gas, which has been produced in the second dry distillation furnace, into the combustion furnace, the oxygen required for the dry distillation of the wastes is supplied to the second dry distillation furnace while controlling the degree of opening of the second valve provided in the second oxygen supply passage such that the temperature in the combustion furnace reaches the first temperature by the combustion of the combustible gas.

Further, in the dry distillation gasification waste incineration method according to the present invention, the operation for switching the combustible gas burnt in the combustion furnace from the combustible gas produced in the first dry distillation furnace to the combustible gas produced in the second dry distillation furnace hereinafter may be abbreviated to "the switching operation") may take any one of the three modes described below.

First, a first mode of the switching operation includes: a step of igniting the wastes held in the second dry distillation furnace and forming a fire bed by controlling a degree of opening of a second valve in the case where the degree of opening of the first valve reaches a first predetermined degree of opening; a step of decreasing the degree of opening of the second valve and supplying a sufficient amount of oxygen required to maintain the fire bed to the second dry distillation furnace through the second oxygen supply passage from the oxygen supply source in the case where, after the fire bed is formed, the degree of opening of the first valve increases beyond the first predetermined degree of opening, and then decreases until reaching a second predetermined degree of opening which is smaller than the first predetermined degree of opening; and a step of increasing the degree of opening of the second valve to dry-distill the wastes held in the second dry distillation furnace so as to produce a combustible gas by using the oxygen supplied to the second dry distillation furnace through the second oxygen supply passage from the oxygen supply source and to start the introduction of the combustible gas, which has been produced in the second dry distillation furnace, into the combustion furnace in a case where the degree of opening of the first valve increases again until reaching a third predetermined degree of opening, which is larger than the second predetermined degree of opening, while control is being carried out such that the temperature in the combustion furnace becomes the first temperature by the combustion of the combustible gas produced in the first dry distillation furnace.

While the control is being carried out such that the temperature in the combustion furnace becomes the first temperature by the combustion of the combustible gas produced in the first dry distillation furnace, the degree of opening of the first valve gradually increases with the progress of the dry distillation of the wastes held in the first dry distillation furnace, and the remaining amount of the wastes in the first dry distillation furnace can be known from the degree of opening of the first valve. Therefore, according to the first mode of the switching operation, when the degree of opening of the first valve reaches the first predetermined degree of opening while the control is being carried out such that the temperature in the combustion furnace becomes the first temperature by the combustion of the combustible gas produced in the first dry distillation furnace, it is determined that the dry distillation of the wastes in the first dry distillation furnace is approaching the final stage, and the wastes held in the second dry distillation furnace are ignited. In the second dry distillation furnace, after the ignition, the degree of opening of the second valve provided in the second oxygen supply passage is controlled thereby to stabilize the combustion of the wastes held in the second dry distillation furnace, and a fire bed is formed.

In the second dry distillation furnace, it is possible to start the dry distillation of wastes in the furnace immediately after the fire bed is formed. At this point, however, a sufficient amount of wastes still remains in the first dry distillation furnace, so that the combustible gas can be produced by the dry distillation of the wastes.

In the case where a sufficient amount of wastes remains in the first dry distillation furnace, if the combustible gas produced in the first dry distillation furnace is excessively supplied to the combustion furnace, then the combustion of the combustible gas in the combustion furnace causes the temperature in the combustion furnace to rise, making it difficult to control the temperature to become the first temperature. For this reason, in the first dry distillation furnace, the degree of opening of the first valve shifts to decrease after increasing beyond the first predetermined degree of opening.

Therefore, in the second dry distillation furnace, when the degree of opening of the first valve shifts to decrease and reaches a second predetermined degree of opening, which is smaller than the first predetermined degree of opening, the degree of opening of the second valve is decreased to supply a sufficient amount of oxygen required to maintain the fire bed into the furnace. Thus, in the second dry distillation furnace, the fire bed is being maintained, whereas the dry distillation of the wastes held in the furnace is not yet started. This state is, in other words, a state in which the dry distillation of the wastes held in the furnace can be immediately started as necessary (hereinafter may be referred to as "the standby state").

Next, in the first dry distillation furnace, the wastes that can produce the combustible gas gradually decrease, and the degree of opening of the first valve gradually increases to control the temperature in the combustion furnace due to the combustion of the combustible gas to become the first temperature. Then, it eventually becomes impossible to control the temperature in the combustion furnace to become the first temperature merely by the combustion of the combustible gas produced in the first dry distillation furnace.

Accordingly, in the second dry distillation furnace, the degree of opening of the first valve increases again to control the temperature in the combustion furnace to become the first temperature and when the degree of opening of the first valve reaches a third predetermined degree of opening, which is larger than the second predetermined degree of opening, the degree of opening of the second valve is increased to start the dry distillation of the wastes held in the furnace. The dry distillation of the wastes in the second dry distillation furnace is performed using the oxygen supplied to the second dry distillation furnace through the second oxygen supply passage from the oxygen supply source. When the dry distillation of the wastes in the second dry distillation furnace is begun, the combustible gas is produced by the dry distillation and the introduction of the combustible gas into the combustion furnace is begun.

As a result, in the combustible furnace, the combustible gas produced in the first dry distillation furnace and the combustible gas produced in the second dry distillation furnace are burnt together, thus making it possible to prevent the temperature in the combustion furnace from significantly decreasing.

Meanwhile, in the first dry distillation furnace, the wastes that can produce the combustible gas further decrease and the combustible gas produced by the dry distillation of the wastes gradually decreases accordingly. Then, the combustible gas produced by the dry distillation of the wastes runs out in the end.

As a result, the combustible gas burnt in the combustion furnace can be smoothly switched from the combustible gas produced in the first dry distillation furnace to the combustible gas produced in the second dry distillation furnace.

Further, the second aspect of the switching operation includes: a step of igniting the wastes held in the second dry distillation furnace and forming a fire bed by controlling a degree of opening of a second valve in the case where the degree of opening of the first valve reaches a first predetermined degree of opening; a step of igniting a combustion device provided in the combustion furnace in a case where the temperature in the combustion furnace decreases and reaches a second predetermined temperature, which is lower than the first temperature; and a step of producing a combustible gas by subjecting the wastes held in the second dry distillation furnace to dry distillation by using oxygen supplied to the second dry distillation furnace through the second oxygen supply passage from the oxygen supply source and starting the introduction of the combustible gas produced in the second dry distillation furnace into the combustion furnace in a case where, after the combustion device is ignited, the temperature in the first dry distillation furnace shifts to decrease and reaches a third predetermined temperature whereas the temperature in the combustion furnace recovers the first temperature.

In the second aspect of the switching operation, the ignition of the wastes held in the second dry distillation furnace and the formation of the fire bed can be performed in exactly the same manner as that of the first aspect of the switching operation. However, depending on the timing of the ignition of the wastes held in the second dry distillation furnace, there are some cases where, during the process of forming the fire bed, the wastes that can produce the combustible gas in the first dry distillation furnace decrease and the temperature in the combustion furnace cannot be controlled to become the first temperature merely by the combustion of the combustible gas produced in the first dry distillation furnace.

In this case, if the temperature in the combustion furnace decreases and reaches the second predetermined temperature, which is lower than the first temperature, then it becomes necessary to carry out control such that the temperature in the combustion furnace becomes the first temperature by igniting the combustion device provided in the combustion furnace. Further, in this case, as the wastes that can produce the combustible gas in the first dry distillation furnace decrease, the temperature in the first dry distillation furnace shifts to decrease and reaches the third predetermined temperature.

Hence, according to the second aspect of the switching operation, when the combustion device is ignited and the temperature in the combustion furnace recovers the first temperature after the temperature in the first dry distillation furnace decreases to the third predetermined temperature, the dry distillation of the wastes held in the second dry distillation furnace is immediately started without shifting to the standby state. When the dry distillation of the wastes held in the second dry distillation furnace is started, the combustible gas is produced by the dry distillation and the introduction of the combustible gas into the combustion furnace is started.

Thus, the second aspect of the switching operation makes it possible to smoothly switch the combustible gas burnt in the combustion furnace from the combustible gas produced in the first dry distillation furnace to the combustible gas produced in the second dry distillation furnace.

Further, a third aspect of the switching operation includes: a step of igniting the wastes held in the second dry distillation furnace and forming a fire bed by controlling a degree of opening of a second valve in the case where the degree of opening of the first valve reaches a first predetermined degree of opening; and a step of producing a combustible gas by subjecting the wastes held in the second dry distillation furnace to dry distillation by using oxygen supplied to the second dry distillation furnace through the second oxygen supply passage from the oxygen supply source and starting the introduction of the combustible gas, which has been produced in the second dry distillation furnace, into the combustion furnace in a case where, after the fire bed is formed, the degree of opening of the first valve increases beyond the first predetermined degree of opening and then decreases to reach a fourth predetermined degree of opening, which is larger than the first predetermined degree of opening whereas the temperature in the combustion furnace temporarily decreases and then recovers the first temperature.

In the third aspect of the switching operation, the ignition of the wastes held in the second dry distillation furnace and the formation of the fire bed can be performed in exactly the same manner as that of the first aspect of the switching operation. However, depending on the timing of the ignition of the wastes held in the second dry distillation furnace, there are some cases where, during the process of forming the fire bed, the wastes that can produce the combustible gas in the first dry distillation furnace decrease and the degree of opening of the first valve gradually increases to control the temperature in the combustion furnace due to the combustion of the combustible to become the first temperature.

In this case, the degree of opening of the first valve increases beyond the first predetermined degree of opening and then decreases until reaching the fourth predetermined degree of opening, which is larger than the first predetermined degree of opening. Further, the temperature in the combustion furnace temporarily decreases and then recovers the first temperature due to an increase in the degree of opening of the first valve, i.e. an increase in the combustible gas produced in the first dry distillation furnace.

Therefore, according to the third aspect of the switching operation, if the degree of opening of the first valve reaches the fourth predetermined degree of opening whereas the temperature in the combustion furnace temporarily decreases and then recovers the first temperature, then the dry distillation of the wastes held in the second dry distillation furnace is immediately started without shifting to the standby state. When the dry distillation of the wastes in the second dry distillation furnace is started, the combustible gas is produced by the dry distillation and the introduction of the combustible gas into the combustion furnace is started.

Thus, the third aspect of the switching operation makes it possible to smoothly switch the combustible gas burnt in the combustion furnace from the combustible gas produced in the first dry distillation furnace to the combustible gas produced in the second dry distillation furnace.

Further, in the dry distillation gasification waste incineration method according to the present invention, there are some cases where the temperature in the combustion furnace significantly increases without being controlled to become the first temperature.

Therefore, in the dry distillation gasification waste incineration method according to the present invention, preferably, the degree of opening of the first valve or the second valve is locked at a predetermined degree of opening when the temperature in the combustion furnace reaches the fourth predetermined temperature, which is higher than the first temperature, and the locked degree of opening of the first valve or the second valve is released when the temperature in the combustion furnace reaches a temperature below the fourth predetermined temperature.

The dry distillation gasification waste incineration method in accordance with the present invention makes it possible to restrict the amount of the combustible gas to be introduced into the combustion furnace by locking the degree of opening of the first valve or the second valve at a predetermined degree of opening when the temperature in the combustion furnace reaches the fourth predetermined temperature, which is higher than the first temperature. As a result, the temperature in the combustion furnace can be controlled to become the first temperature.

The locking of the degree of opening of the first valve or the second valve is released when the temperature in the combustion furnace reaches a temperature below the fourth predetermined temperature, thus restoring normal control.

In the dry distillation gasification waste incineration method in accordance with the present invention, two or three or more dry distillation furnaces may be provided for one combustion furnace insofar as a plurality of dry distillation furnaces are provided, the two dry distillation furnaces, for example, being provided in the present invention.

Further, the dry distillation gasification waste incineration method in accordance with the present invention includes a step of loading new wastes in the first dry distillation furnace after removing, from the first dry distillation furnace, the wastes that have been ashed in the first dry distillation furnace at the time of the dry distillation of wastes held in the second dry distillation furnace, wherein the dry distillation of the wastes in the first dry distillation furnace and the dry distillation of the wastes in the second dry distillation furnace are alternately repeated.

According to the dry distillation gasification waste incineration method in accordance with the present invention, in the case where one such combustion furnace is provided with two such dry distillation furnaces, the wastes that can produce the combustible gas run out in the first dry distillation furnace and the wastes are ashed while the wastes in the second dry distillation furnace are being subjected to dry distillation.

Therefore, when the wastes in the second dry distillation furnace are being subjected to dry distillation, the wastes that have been ashed in the first dry distillation furnace are removed and new wastes are loaded into the first dry distillation furnace to prepare for the next dry distillation. The preparation for the next dry distillation can be performed in the same manner as that for the second dry distillation furnace, and the combustion furnace can be continuously operated by alternately repeating the dry distillation of the wastes in the first dry distillation furnace and the dry distillation of the wastes in the second dry distillation furnace.

DESCRIPTION OF EMBODIMENTS

The following will describe an embodiment of the present invention in more detail with reference to the accompanying drawings.

Figure 1:
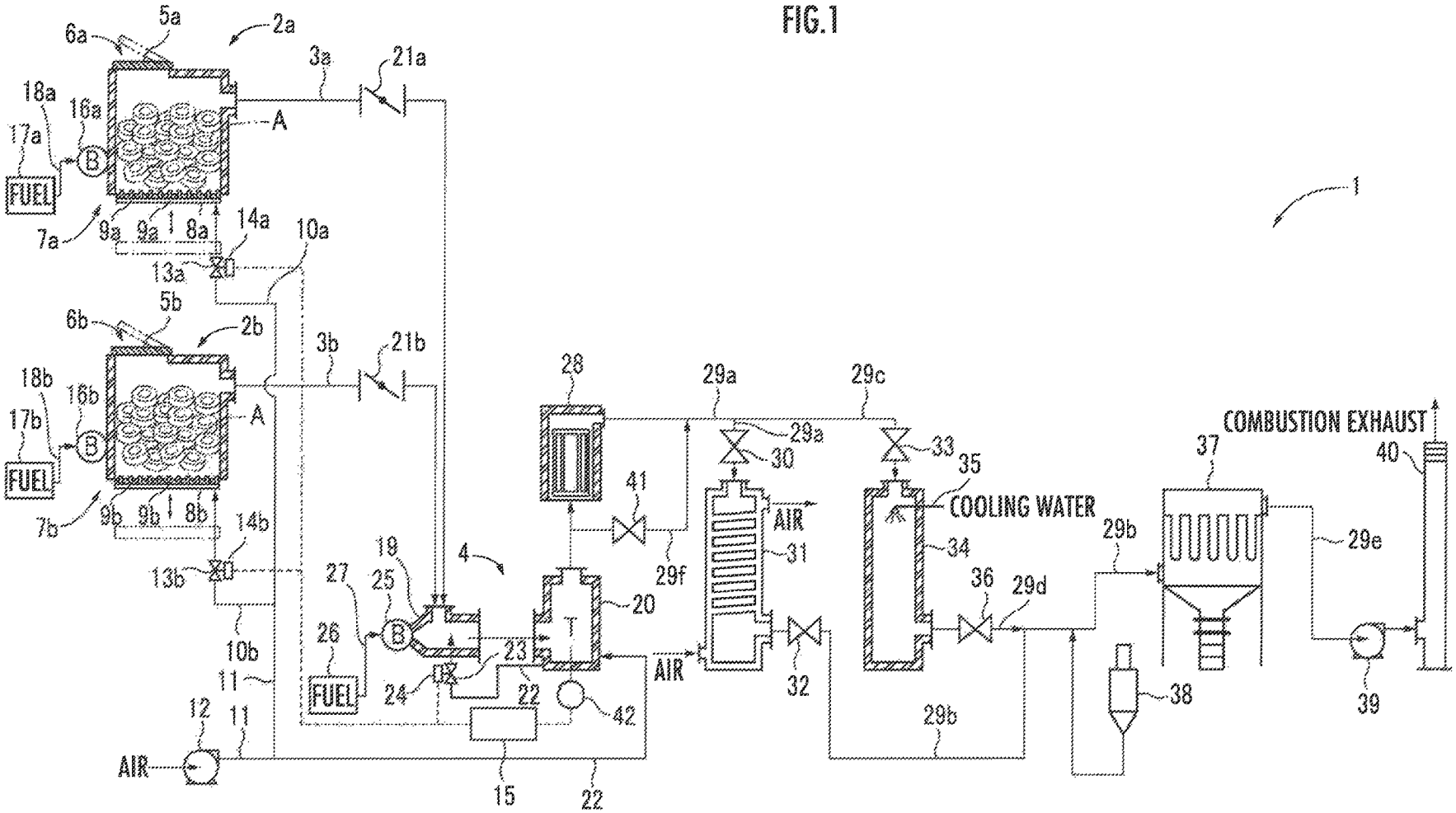
FIG. 1 is a system configuration diagram illustrating the configuration of a dry distillation gasification incineration apparatus used for the method in accordance with the present invention.

The dry distillation gasification waste incineration method according to the present embodiment is implemented by using a dry distillation gasification incineration apparatus 1 illustrated in FIG. 1.

The dry distillation gasification incineration apparatus 1 includes two dry distillation furnaces 2*a*, 2*b*, which hold wastes A, such as waste tires, and perform dry distillation gasification and incineration of the wastes, and a combustion furnace 4 connected to the dry distillation furnaces 2*a*, 2*b* through gas passages 3*a*, 3*b*.

Formed in the upper surface portions of the dry distillation furnaces 2*a*, 2*b* are loading ports 6*a*, 6*b* provided with openable/closable loading doors 5*a*, 5*b*, respectively, so that the wastes A can be loaded into the dry distillation furnaces 2*a*, 2*b* through the loading ports 6*a*, 6*b*. Further, with the loading doors 5*a*, 5*b* closed, the interiors of the dry distillation furnaces 2*a*, 2*b* are substantially shut off from the outside. The dry distillation furnaces 2*a*, 2*b* may be provided with weighing instruments (not illustrated), which measure a predetermined amount of the wastes A before the wastes A are loaded into the dry distillation furnaces 2*a*, 2*b* through the loading ports 6*a*, 6*b*.

Formed on the outer peripheral portions of the dry distillation furnaces 2*a*, 2*b* are water jackets, which are cooling structures, (not illustrated) isolated from the interiors of the dry distillation furnaces 2*a*, 2*b*. Water is supplied to the water jackets by a water supply apparatus, which is not illustrated, such that the water inside the water jackets is maintained at a predetermined water level.

The lower portions of the dry distillation furnaces 2*a*, 2*b* have bottom doors 7*a*, 7*b*, which are movable downward. With the bottom doors 7*a*, 7*b* closed, the interiors of the dry distillation furnaces 2*a*, 2*b* are substantially shut off from the outside. Formed at the bottom portions of the bottom doors 7*a*, 7*b* are vacant chambers 8*a*, 8*b* isolated from the interiors of the dry distillation furnaces 2*a*, 2*b*. The vacant chambers 8*a*, 8*b* are in communication with the interiors of the dry distillation furnaces 2*a*, 2*b* through a plurality of air supply nozzles 9*a*, 9*b* provided on the bottom doors 7*a*, 7*b*.

Dry distillation oxygen supply passages 10*a*, 10*b* are connected to the vacant chambers 8*a*, 8*b*, respectively, at the bottoms of the dry distillation furnaces 2*a*, 2*b*. The dry distillation oxygen supply passages 10*a*, 10*b* are connected to an oxygen supply source 12, which is composed of a forced draft fan and the like, through an oxygen supply passage 11. The dry distillation oxygen supply passages 10*a*, 10*b* are provided with control valves 13*a*, 13*b*, respectively. The degrees of opening of the control valves 13*a*, 13*b* are controlled by valve drives 14*a*, 14*b*. In this case, the valve drives 14*a*, 14*b* are controlled by a controller 15 composed of an electronic circuit, including a CPU and the like.

Further, ignition units 16*a*, 16*b* for igniting the wastes A held in the dry distillation furnaces 2*a*, 2*b* are installed at the lower portions of the div distillation furnaces 2*a*, 2*b*. The ignition units 16*a*, 16*b* are composed of ignition burners or the like and adapted to burn a fuel supplied through fuel supply passages 18*a*, 18*b* from fuel supply units 17*a*, 17*b*, thereby supplying combustion flames to the wastes A. A fuel, such as light oil, is retained in the fuel supply units 17*a*, 17*b*.

The combustion furnace 4 is comprised of a burner 19, which mixes a combustible gas produced by the dry distillation of the wastes A and oxygen (air) required for the complete combustion thereof, and a combustion unit 20 which burns a combustible gas mixed with oxygen (air). The combustion unit 20 is in communication with the burner 19 on the downstream side of the burner 19. Gas passages 3*a*, 3*b* are connected to the upstream side of the burner 19 through dumpers 21*a*, 21*b*, respectively, and the combustible gas produced by the dry distillation of the wastes A in the dry distillation furnaces 2*a*, 2*b* is introduced into the burner 19 through the gas passages 3*a*, 3*b*.

Formed on the outer peripheral portion of the burner 19 is a vacant chamber (not illustrated) isolated from the interior of the burner 19. The vacant chamber is in communication with the interior of the burner 19 through a plurality of nozzle holes (not illustrated) drilled in the inner peripheral portion of the burner 19. A combustion oxygen supply passage 22 branched from the oxygen supply passage 11 is connected to the vacant chamber. The combustion oxygen supply passage 22 is laid out to pass through the combustion unit 20 in the middle, so that the oxygen (air) preheated inside the combustion unit 20 is supplied to the vacant chamber.

The combustion oxygen supply passage 22 is provided with a control valve 23. The degree of opening of the control valve 23 is controlled by a valve drive 24. In this case, the valve drive 24 is controlled by the controller 15.

A combustion unit 25 is installed on the upstream side of the burner 19. The combustion unit 25 is comprised of an ignition burner or the like, and burns a fuel supplied from a fuel supply unit 26 through a fuel supply passage 27, thereby igniting a combustible gas introduced into the burner 19 or preheating the combustion furnace 4. A fuel, such as light oil, is retained in the fuel supply unit 26.

A hot water boiler 28 heated by the combustion exhaust from the combustion in the combustion furnace 4 is installed on the downstream side of the combustion unit 20. Water is supplied to the hot water boiler 28 from a water supply unit, which is not illustrated, and the hot water heated by making use of the combustion heat of the wastes A is used for air conditioning or the like.

Provided on the outlet side of the hot water boiler 28 is a duct 29*a* through which the combustion exhaust cooled in the hot water boiler 28 is discharged, the duct 29*a* being connected to the upper end of an air-cooled heat exchanger 31 through an on-off valve 30. Air supplied through a forced draft fan or the like, which is not illustrated, is circulated through the air-cooled heat exchanger 31 and carries out heat exchange with the combustion exhaust introduced through the duct 29*a*, thereby cooling the combustion exhaust. The combustion exhaust cooled by the air-cooled heat exchanger 31 is taken out through a duct 29*b* connected to the lower part of the air-cooled heat exchanger 31 through an on-off valve 32.

Meanwhile, a duct 29*c* is branched from the duct 29*a* on the upstream side of the on-off valve 30, and the duct 29*c* is connected to the upper end of a rapid cooling tower 34 through an on-off valve 33. The rapid cooling tower 34 is provided with a spray 35, which cools the combustion exhaust, which is introduced through the duct 29*c*, by sprinkling water thereto. The spray 35 is connected to a water supply unit (not illustrated), which supplies cooling water, and an air compressor (not illustrated).

The combustion exhaust cooled by the rapid cooling tower 34 is taken out from a duct 29*d* connected to the lower portion of the rapid cooling tower 34 through an on-off valve 36. The duct 29*d* merges with the duct 29*b* on the downstream side of the on-off valves 32, 36.

The duct 29*b* is connected to one end of a bug filter 37. Slaked lime and activated carbon supplied from a drug silo 38 are mixed with the combustion exhaust introduced to the bug filter 37 through the duct 29*b*, thereby carrying out desulfurization and deodorization.

The bug filter 37 is provided with a filter section and a recovery section, which recovers ash or the like separated from the combustion exhaust by filter section. An air compressor (not illustrated) is connected to the filter section to clean the filter section. A duct 29*e* is connected to the other end of the bug filter 37, and the duct 29*e* is connected to a chimney 40 through an inducing fan 39, which draws in the combustion exhaust in the combustion furnace 4. Thus, the combustion exhaust circulated through the duct 29*e* is released into the atmosphere from the chimney 40.

Further, a duct 29*f* for discharging the combustion exhaust when the hot water boiler 28 is not used is provided on the downstream side of the combustion furnace 4, the duct 29*f* being connected to the duct 29*a* on the downstream side of the hot water boiler 28 through an on-off valve 41. Further, in the dry distillation gasification incineration apparatus 1 according to the present embodiment, the combustion furnace 4 has a temperature sensor 42, which detects a temperature Tc in the combustion furnace 4 and which is provided at a position facing the downstream side of the burner 19. The detection signals of the temperature sensor 42 are input to the controller 15.

Figure 2:
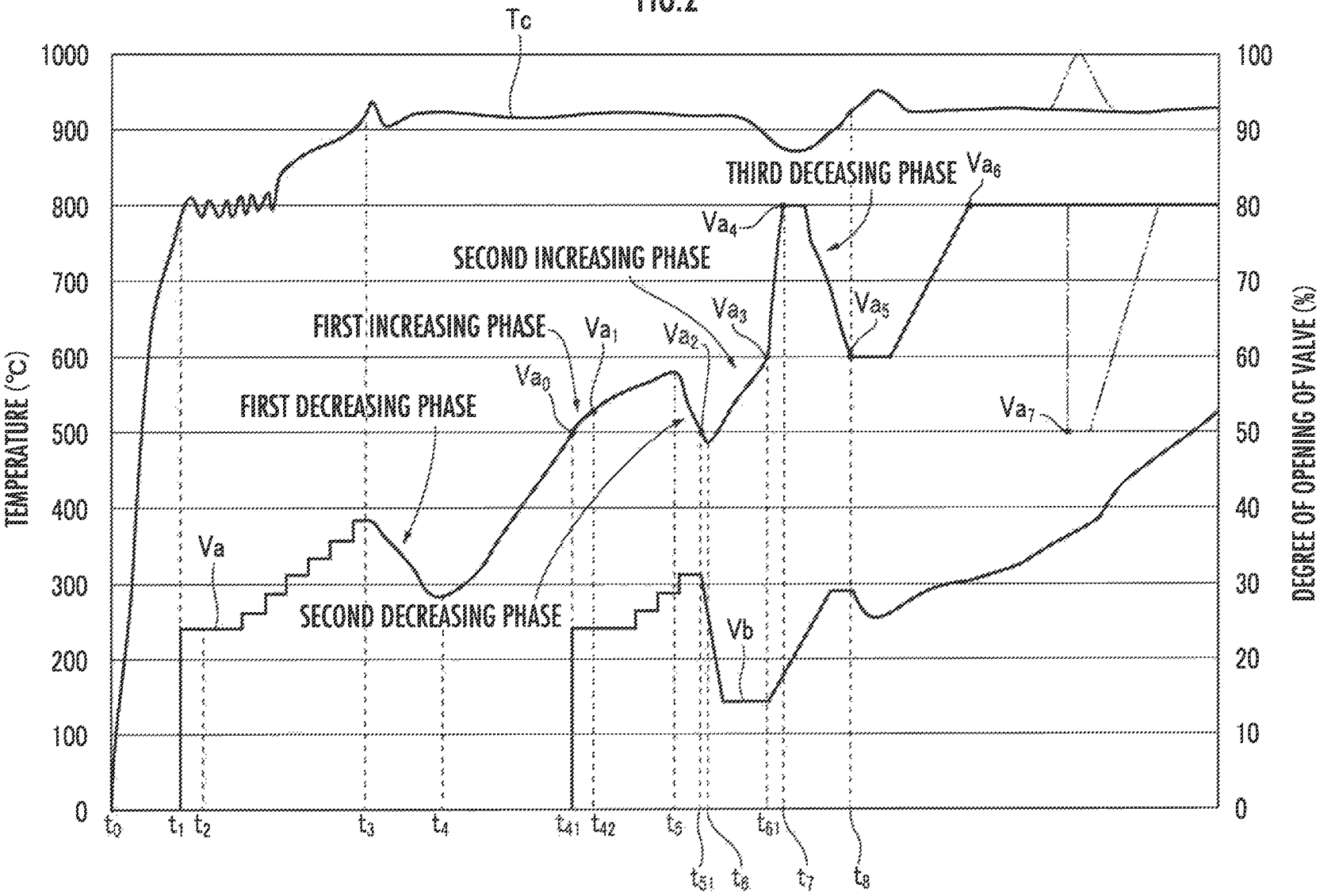
FIG. 2 is a graph illustrating the temporal changes in the temperature in a combustion furnace and the degrees of opening of the valves provided in a first and a second oxygen supply passages in a first aspect of a switching operation.

Referring now to FIG. 1 and FIG. 2, a description will be given of a first aspect of the dry distillation gasification waste incineration method according to the present embodiment using the dry distillation gasification incineration apparatus 1.

To incinerate the wastes A in the dry distillation gasification incineration apparatus 1, the loading door 5*a* of the dry distillation furnace 2*a* is first opened, with the bottom door 7*a* closed, and the wastes A, such as waste tires, are put in the dry distillation furnace 2*a* through the loading port 6*a*. If the dry distillation furnace 2*a* is provided with the weighing instrument, then a predetermined amount of wastes A is measured by the weighing instrument before the wastes A are loaded into the dry distillation furnace 2*a* through the loading port 6*a*.

Then, the controller 15 detects that the loading of the wastes A into the dry distillation furnace 2*a* has been completed and the wastes A are present in the dry distillation furnace 2*a*. The completion of the loading of the wastes A into the dry distillation furnace 2*a* can be detected by, for example, providing a limit switch that turns ON when the loading door 5*a* and the bottom door 7*a* are closed, and by detecting that the limit switch is ON. Further, if the dry distillation furnace 2*a* is provided with the weighing instrument, then the weighing instrument may be provided with a loading completion button so as to detect the operation state of the loading completion button. In addition, the completion of the loading may be detected by detecting that the foregoing two limit switches are ON and also by detecting the operation state of the loading completion button.

Subsequently, the loading door 5*a* is closed to place the interior of the dry distillation furnace 2*a* in a tightly sealed state, and then, prior to the ignition of the wastes A, the combustion unit 25 of the combustion furnace 4 is actuated at time $t_0$ illustrated in FIG. 2 thereby to start preheating the combustion furnace 4 by the combustion of a fuel supplied through the fuel supply passage 27 from the fuel supply unit 26.

Then, as illustrated in FIG. 2, the temperature Tc in the combustion furnace 4 detected by the temperature sensor 42 gradually increases due to the combustion of the fuel, and when the temperature Tc reaches, for example, 760° C. at time $t_1$, the valve drive 14*a* is driven by the controller 15 to set a degree of opening Va of the control valve 13*a* at a predetermined degree of opening, e.g. 25%, and the supply of oxygen (air) to the dry distillation furnace 2*a* from the oxygen supply source 12 through the oxygen supply passage 11 and a dry distillation oxygen supply passage 10*a* is started.

If the controller 15 detects that the loading of the wastes A into the dry distillation furnace 2*a* has been completed, the wastes A are present in the dry distillation furnace 2*a*, and the dumper 21*a* is open, then the ignition unit 16*a* of the dry distillation furnace 2*a* is actuated in a predetermined time from time $t_1$, e.g. in five minutes, to time $t_2$. Thus, the fuel supplied from the fuel supply unit 17*a* through the fuel supply passage 18*a* is burnt by the ignition unit 16*a*, thereby igniting the wastes A to start the partial combustion of the wastes A.

Next, in the dry distillation furnace 2*a*, the valve drive 14*a* is controlled by the controller 15, and the degree of opening Va of the control valve 13*a* is increased in steps during the period of time $t_2$ to $t_3$. This causes the partial combustion of the wastes A in the dry distillation furnace 2*a* to gradually expand by the oxygen (air) supplied from the oxygen supply source 12 and become stable, thus forming a fire bed at the bottom part of the wastes A. Upon the formation of the fire bed, the ignition unit 16*a* is stopped, and the dry distillation of the rest of the wastes A is started by the heat of the partial combustion of the wastes A, thus starting the production of the combustible gas. The production of the combustible gas can be detected by, for example, a rise in temperature detected by a temperature sensor (not illustrated) provided at a position facing the dry distillation furnace 2*a* of a gas passage 3*a*.

The internal space of the dry distillation furnace 2*a* is suctioned by the inducing fan 39 through the combustion furnace 4, so that the combustible gas is introduced into the burner 19 through the gas passage 3*a*. In the burner 19, the valve drive 24 is driven by the controller 15 to set the degree of opening of the control valve 23 at the predetermined degree of opening, and oxygen (air) is supplied from the oxygen supply source 12 through the oxygen supply passage 11 and the combustion oxygen supply passage 22. Therein, the combustible gas is mixed with the oxygen (air) supplied through the combustion oxygen supply passage 22 and ignited by a combustion flame supplied from the combustion unit 25, thus starting the combustion in the combustion unit 20.

Until the fire bed is formed, the temperature Tc in the combustion furnace 4 due to the combustion of the combustible gas slightly fluctuates up and down in the vicinity of 800° C. for a while, but eventually, as the production of the combustible gas becomes active and natural combustion is started, the temperature Tc gradually increases and reaches a predetermined first temperature (hereinafter referred to as "the first set temperature"), e.g. 930° C., at time $t_3$.

When the temperature Tc in the combustion furnace 4 reaches the first set temperature due to the combustion of the combustible gas, the combustion unit 25 is stopped, and after time $t_3$, the controller 15 starts the feedback control of the production of the combustible gas in the dry distillation furnace 2*a*. Thus, the degree of opening Va of the control valve 13*a* is controlled such that the temperature Tc in the combustion furnace 4 reaches the first set temperature by the combustion of the combustible gas.

While the production of the combustible gas is being feedback-controlled by the controller 15 such that the temperature Tc in the combustion furnace 4 becomes the first set temperature, if the temperature Tc in the combustion furnace 4 decreases and reaches a second set temperature, e.g. 875°

C., which is lower than the first set temperature, then the combustion unit 25 is actuated again to heat the combustion furnace 4 by the heating power of the combustion unit 25. The combustion unit 25 is stopped when the temperature Tc in the combustion furnace 4 restores the first set temperature.

The combustion exhaust generated by the combustion of the combustible gas in the combustion unit 20 is cooled by the heat exchange in the hot water boiler 28 with the water circulated through the hot water boiler 28 and discharged into the duct 29*a*. Alternatively, the combustion exhaust is discharged into the duct 29*a* through the duct 29*f* without passing through the hot water boiler 28 by opening the on-off valve 41.

If the combustion exhaust passes through the hot water boiler 28, the combustion exhaust discharged into the duct 29*a* is introduced into the air-cooled heat exchanger 31 from the duct 29*a* to be further cooled by the heat exchange with air circulated through the air-cooled heat exchanger 31, and discharged into the duct 29*b*. At this time, the on-off valves 30, 32 located before and after the air-cooled heat exchanger 31 are open, while the on-off valves 33, 36 located before and after the rapid cooling tower 34 are closed.

Further, if the combustion exhaust discharged into the duct 29*a* does not pass through the hot water boiler 28, then the combustion exhaust is introduced into the rapid cooling tower 34 from the duct 29*c* and cooled by the cooling water sprinkled from a spray 35, and discharged into the duct 29*b* through the duct 29*d*. At this time, the on-off valves 30, 32 located before and after the air-cooled heat exchanger 31 are closed, while the on-off valves 33, 36 located before and after the rapid cooling tower 34 are open.

Subsequently, the combustion exhaust discharged into the duct 29*b* is mixed with slaked lime and activated carbon supplied from the drug silo 38 to carry out desulfurization and deodorization, and introduced to the bug filter 37 so as to remove ash, dust and the like, before being discharged into the duct 29*e* and then released into the atmosphere through the chimney 40.

Until time $t_3$ at which the feedback control of the production of the combustible gas in the dry distillation furnace 2*a* is started, the degree of opening Va of the control valve 13*a* is increased in steps to increase the temperature Tc in the combustion furnace 4 by the combustion of the combustible gas. However, if the degree of opening Va is increased after the temperature Tc in the combustion furnace 4 reaches the first set temperature, then the temperature Tc in the combustion furnace 4 continues to increase beyond the first set temperature, because a sufficient amount of the wastes A that enables the combustible gas to be produced by dry distillation still remains in the dry distillation furnace 2*a* at that point of time.

Therefore, as illustrated in FIG. 2, after time $t_3$, the degree of opening Va of the control valve 13*a* is controlled by the controller 15 through the valve drive 14*a* such that the degree of opening Va of the control valve 13*a* repeats slight increases and decreases, indicating a temporary decreasing trend as a whole until time $t_4$ (a first decreasing phase). During the period of time $t_3$ to $t_4$, the remaining amount of the wastes A that can produce the combustible gas by dry distillation in the dry distillation furnace 2*a* gradually decreases. When time $t_4$ is reached, further decreasing the degree of opening Va of the control valve 13*a* would cause an excessive decrease of the temperature Tc in the combustion furnace 4, making it difficult to control the temperature Tc to become the first set temperature.

Therefore, after time $t_4$, the degree of opening Va of the control valve 13*a* is controlled by the controller 15 through the valve drive 14*a* such that the degree of opening Va of the control valve 13*a* repeats slight increases and decreases, indicating an increasing trend as a whole via a degree of opening $Va_0$ (e.g. 50%) and a degree of opening $Va_1$ (e.g. 53%) until time $t_5$ (a first increasing phase). During the period of time $t_4$ to $t_5$, the remaining amount of the wastes A that can produce the combustible gas by dry distillation in the dry distillation furnace 2*a* further decreases; however, during this period, the degree of opening Va of the control valve 13*a* is increased, so that the wastes A that are sufficient for producing more combustible gas remain. As a result, when time $t_5$ is reached, further increasing the degree of opening Va of the control valve 13*a* will cause the temperature Tc in the combustion furnace 4 to excessively increase, making it difficult to maintain the temperature Tc at the first set temperature.

Therefore, the degree of opening Va of the control valve 13*a* is controlled by the controller 15 through the valve drive 14*a* such that, after reaching a maximum at time $t_5$ via a degree of opening $Va_1$ (e.g. 53%), the degree of opening Va of the control valve 13*a* repeats slight increases and decreases, indicating a decreasing trend as a whole via a degree of opening $Va_1$ (e.g. 50%) until time $t_6$ (a second decreasing phase). During the period of time $t_5$ to $t_6$, the remaining amount of the wastes A that can produce the combustible gas by dry distillation in the dry distillation furnace 2*a* further decreases. When time $t_6$ is reached, further decreasing the degree of opening Va of the control valve 13*a* will cause the temperature Tc in the combustion furnace 4 to excessively decrease, making it difficult to control the temperature Tc to become the first set temperature.

Therefore, the degree of opening Va of the control valve 13*a* is controlled by the controller 15 through the valve drive 14*a* such that, after reaching a minimum at time $t_6$ via a degree of opening $Va_2$ (e.g. 50%), the degree of opening Va of the control valve 13*a* repeats slight increases and decreases, indicating a rapidly increasing trend as a whole via a degree of opening $Va_3$ (e.g. 60%), and reaches a degree of opening $Va_1$ (e.g. 80%) at time $t_7$ (a second increasing phase). During the period of time $t_6$ to $t_7$, the wastes A that can produce the combustible gas by dry distillation in the dry distillation furnace 2*a* are mostly lost. However, at time $t_7$, the production of the combustible gas by the dry distillation of the wastes A in a second dry distillation furnace 2*b* is started and the combustible gas produced in the second dry distillation furnace 2*b* is introduced into the combustion furnace 4, as will be discussed hereinafter.

Hence, after starting the introduction of the combustible gas, which has been produced in the second dry distillation furnace 2*b*, into the combustion furnace 4, the controller 15 controls the degree of opening Va of the control valve 13*a* such that the temperature Tc in the combustion furnace 4 obtained by combining the combustion of the combustible gas produced in the first dry distillation furnace 2*a* and the combustion of the combustible gas produced in the second dry distillation furnace 2*b* becomes the first set temperature. Thus, the degree of opening Va of the control valve 13*a* is controlled by the controller 15 through the valve drive 14*a* such that the degree of opening Va of the control valve 13*a* repeats slight increases and decreases, indicating a decreasing trend as a whole (a third decreasing phase).

However, in the third deceasing phase, the production of a small amount of the combustible gas continues in the first dry distillation furnace 2*a*, so that the interaction with the combustible gas produced in the second dry distillation furnace 2*b* may cause the temperature Tc in the combustion furnace 4 to rapidly increase and exceed the first set temperature Tc at, for example, time $t_8$.

Therefore, if the temperature Tc in the combustion furnace 4 reaches a predetermined temperature (a fourth predetermined temperature Tc in claim 6), e.g. 915° C., which is higher than the first set temperature, the controller 15 locks the degree of opening Va of the control valve 13*a* at a predetermined degree of opening $Va_5$, e.g. 60%, through the valve drive 14*a*. The control for locking the degree of opening Va of the control valve 13*a* at the degree of opening $Va_5$ by the controller 15 is released when the temperature Tc in the combustion furnace 4 is reset to the first set temperature. Thereafter, the controller 15 increases the degree of opening Va of the control valve 13*a* to a predetermined degree of opening $Va_6$, e.g. 80%, through the valve drive 14*a*, locks the degree of opening Va of the control valve 13*a* at the degree of opening $Va_6$, and ashes the wastes A in the dry distillation furnace 2*a*.

Further, while the degree of opening Va of the control valve 13*a* is being locked at the predetermined degree of opening $Va_6$ by the controller 15, the temperature Tc in the combustion furnace 4 may increase and reach a predetermined temperature, e.g. 915° C. (the fourth predetermined temperature in claim 6), which is higher than the first set temperature, as indicated by the virtual line in FIG. 2. In this case, the increase in the temperature Tc is considered due to a part of the wastes A remaining in the dry distillation furnace 2*a* that can produce the combustible gas by dry distillation, because the production of the combustible gas in the dry distillation furnace 2*b* is under feedback control, as will be discussed later.

In this case, therefore, the controller 15 decreases the degree of opening Va of the control valve 13*a* and locks the degree of opening Va at a predetermined degree of opening $Va_7$, e.g. 50%, through the valve drive 14*a*. The control for locking the degree of opening Va of the control valve 13*a* at the degree of opening $Va_7$ by the controller 15 is released when the temperature Tc in the combustion furnace 4 reaches a temperature below a predetermined temperature that is higher than the first set temperature.

Although not illustrated, after the wastes A in the dry distillation furnace 2*a* are ashed, the controller 15 decreases the degree of opening Va of the control valve 13*a* at a predetermined rate through the valve drive 14*a* until the control valve 13*a* is closed.

In the dry distillation furnace 2*a*, when the ashing of the wastes A is completed and the control valve 13*a* is closed, the bottom door 7*a* is moved down to discharge the wastes A which have been ashed, and the bottom door 7*a* is reset to the original position thereof. Then, the loading door 5*a* is opened, and the wastes A, such as waste tires, are loaded into the dry distillation furnace 2*a* through the loading port 6*a* to prepare for the next processing.

In the first aspect of the dry distillation gasification waste incineration method according to the present embodiment, as illustrated in FIG. 2, after the temperature Tc in the combustion furnace 4 reaches the first set temperature at time $t_3$ due to the combustion of the combustible gas produced in the dry distillation furnace 2*a*, the loading door 5*b* is opened, with the bottom door 7*b* of the dry distillation furnace 2*b* closed, and the wastes A, such as waste tires, are loaded into the dry distillation furnace 2*b* through a loading port 6*b*. The wastes A can be loaded into the dry distillation furnace 2*b* in the same manner as that for loading the wastes A into the dry distillation furnace 2*a*.

Subsequently, after the controller 15 detects that the loading of the wastes A into the dry distillation furnace 2*b* is complete and that the wastes A are present in the dry distillation furnace 2*b*, when the degree of opening Va of the control valve 13*a* in the dry distillation furnace 2*a* reaches a predetermined degree of opening $Va_0$, e.g. 50%, at time $t_{41}$ in the first increasing phase, the dumper 21*b* is opened, the valve drive 14*b* in the dry distillation furnace 2*b* is driven by the controller 15 to set the degree of opening Vb of the control valve 13*b* to a predetermined degree of opening, e.g. 25%, and oxygen (air) is supplied to the dry distillation furnace 2*b* from the oxygen supply source 12 through the oxygen supply passage 11 and the dry distillation oxygen supply passage 10*b*, as illustrated in FIG. 2.

Subsequently, when the degree of opening Va of the control valve 13*a* in the dry distillation furnace 2*a* reaches the first predetermined degree of opening $Va_1$, e.g. 53%, at time $t_{42}$ in the first increasing phase, the ignition unit 16*b* of the dry distillation furnace 2*b* is actuated. As a result, the wastes A in the dry distillation furnace 2*b* are ignited by the combustion of a fuel supplied from the fuel supply unit 17*b* through the fuel supply passage 18*b*, thus starting the partial combustion of the wastes A.

The detection of the completion of the loading of the wastes A into the dry distillation furnace 2*b* and the presence of the wastes A in the dry distillation furnace 2*b* by the controller 15 can be performed in the same manner as that for the dry distillation furnace 2*a*.

The wastes A in the dry distillation furnace 2*b* may alternatively be ignited when the degree of opening Va of the control valve 13*a* reaches the first predetermined degree of opening $Va_1$ and the temperature in the dry distillation furnace 2*a* reaches, for example, 200° C. The wastes A in the dry distillation furnace 2*b* can be securely ignited at a proper timing by detecting both the degree of opening Va of the control valve 13*a* and the temperature in the dry distillation furnace 2*a*.

Subsequently, in the dry distillation furnace 2*b*, the valve drive 14*b* is controlled by the controller 15 to increase the degree of opening Vb of the control valve 13*b* in steps. This causes the partial combustion of the wastes A in the dry distillation furnace 2*b* to gradually expand by the oxygen (air) supplied from the oxygen supply source 12 and become stable, thus forming a fire bed on the bottom part of the wastes A. Upon the formation of the fire bed, the ignition unit 16*b* is stopped.

Subsequently, when the degree of opening Va of the control valve 13*a* in the dry distillation furnace 2*a* reaches a second predetermined degree of opening $Va_2$, e.g. 50%, which is smaller than the first predetermined degree of opening $Va_1$, at time $t_{51}$ in the second decreasing phase, the valve drive 14*b* is controlled by the controller 15 to decrease the degree of opening Vb of the control valve 13*b* to, for example, 15%, and a sufficient amount of oxygen (air) required to maintain the fire bed is supplied to the dry distillation furnace 2*b* from the oxygen supply source 12 through the oxygen supply passage 11 and the dry distillation oxygen supply passage 10*b*.

As a result, the dry distillation furnace 2*b* is placed in a state in which the dry distillation of the wastes A held in the furnace has not yet started, whereas the fire bed is being maintained, i.e. in a standby state in which the dry distillation of the wastes A can be immediately started as necessary. While the dry distillation furnace 2*b* is in the standby state, the degree of opening Vb of the control valve 13*b* is maintained at an opening that allows a sufficient amount of oxygen (air) required for maintaining the fire bed to be supplied to the dry distillation furnace 2*b*.

Subsequently, when the degree of opening Va of the control valve 13*a* in the dry distillation furnace 2*a* reaches a third predetermined degree of opening $Va_3$, e.g. 60%, which is larger than the second predetermined degree of opening $Va_2$, at time $t_{61}$ in the second increasing phase, the valve drive 14*b* is controlled by the controller 15 in the dry distillation furnace 2*b* to increase the degree of opening Vb of the control valve 13*b*. This causes the standby state to be cleared, so that the dry distillation of the wastes A held in the dry distillation furnace 2*b* is started, and the combustible gas produced in the dry distillation furnace 2*b* is introduced into the burner 19 of the combustion furnace 4 through a gas passage 3*b*. The production of the combustible gas can be detected by, for example, a rise in temperature detected by a temperature sensor (not illustrated) provided at a position facing the dry distillation furnace 2*b* of a gas passage 3*b*, as with the case of the dry distillation furnace 2*a*.

Subsequently, after the introduction of the combustible gas, which has been produced in the second dry distillation furnace 2*b*, into the combustion furnace 4 is started, the controller 15 controls the degree of opening Va of the control valve 13*a* such that the temperature Tc in the combustion furnace 4 obtained by combining the combustion of the combustible gas produced in the first dry distillation furnace 2*a* and the combustion of the combustible gas produced in the second dry distillation furnace 2*b* becomes the first set temperature, as described above. Thus, the degree of opening Va of the control valve 13*a* reaches a maximum degree of opening $Va_4$, e.g. 80%, beyond the third predetermined degree of opening $Va_3$, and then shifts to the decreasing trend (the third decreasing phase).

Subsequently, at time $t_8$, the controller 15 locks the degree of opening Va of the control valve 13*a* at a predetermined degree of opening $Va_5$ through the valve drive 14*a*, and also controls the degree of opening Vb of the control valve 13*b* such that the temperature Tc in the combustion furnace 4 due to the combustion of the combustible gas produced in the dry distillation furnace 2*b* becomes the first set temperature, thus feedback-controlling the production of the combustible gas in the dry distillation furnace 2*b*. Meanwhile, the generation of the combustible gas in the dry distillation furnace 2*a* completely stops, and the combustible gas to be burnt in the combustion furnace 4 is switched from the combustible gas produced in the dry distillation furnace 2*a* to the combustible gas produced in the dry distillation furnace 2*b*.

Thus, the first aspect of the dry distillation gasification waste incineration method according to the present embodiment makes it possible to smoothly switch the combustible gas to be burnt in the combustion furnace 4 from the combustible gas produced in the dry distillation furnace 2*a* to the combustible gas produced in the dry distillation furnace 2*b*.

Figure 3:
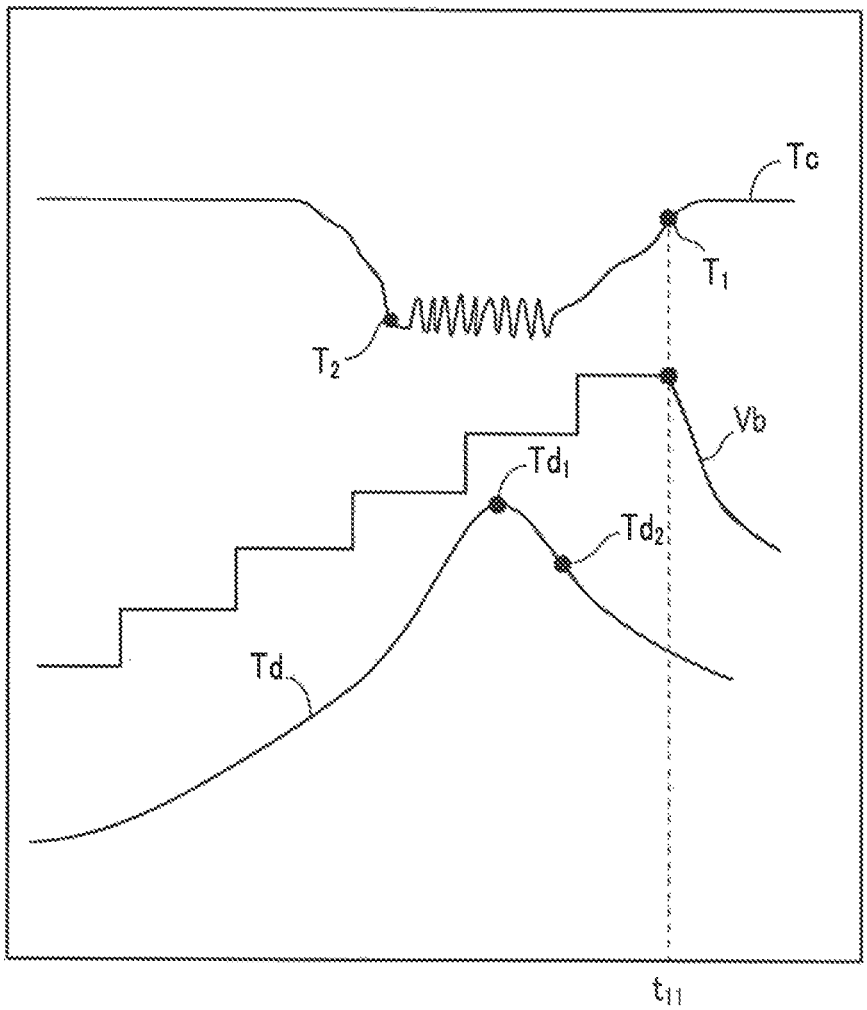
FIG. 3 is a graph illustrating the temporal changes in the temperature in a combustion furnace, the temperature in a first dry distillation furnace, and the degree of opening of a valve provided in a second oxygen supply passage in a second aspect of the switching operation.

Referring now to FIG. 3, a description will be given of a second aspect of the dry distillation gasification waste incineration method according to the present embodiment using a dry distillation gasification incineration apparatus 1.

In the dry distillation gasification incineration apparatus 1, the operation for igniting the wastes A in the dry distillation furnace 2*b* can be performed by the controller 15 actuating the ignition unit 16*b* when the degree of opening Va of the control valve 13*a* in the dry distillation furnace 2*a* reaches the first predetermined degree of opening $Va_1$, as described above. Further, the operation for forming a fire bed in the wastes A in the dry distillation furnace 2*b* can be performed by the controller 15 controlling the valve drive 14*b* to increase the opening Vb of the control valve 13*b* in steps, as described above.

However, depending on the timing of the ignition of the wastes Ain the dry distillation furnace 2*b*, there are cases where, during the process of forming the fire bed, the wastes A that can produce the combustible gas in the dry distillation furnace 2*a* decrease and the temperature Tc in the combustion furnace 4 can no longer be controlled to the first set temperature $T_1$, e.g. 955° C., merely by the combustion of the combustible gas produced in the dry distillation furnace 2*a*.

In this case, as illustrated in FIG. 3, if the temperature Tc in the combustion furnace 4 decreases and reaches a second predetermined temperature $T_2$, e.g. 875° C., which is lower than the first set temperature $T_1$, then a combustion unit 25 is ignited. This causes the temperature Tc in the combustion furnace 4 to slightly fluctuate up and down in the vicinity of the temperature $T_2$, preventing a further decrease. In this case, the wastes A that can produce the combustible gas by dry distillation decrease in the dry distillation furnace 2*a*, so that a temperature Td in the dry distillation furnace 2*a* shifts to decrease after reaching a maximum temperature $Td_1$ during the process of forming the fire bed in the dry distillation furnace 2*b*.

Therefore, in the second aspect of the dry distillation gasification waste incineration method according to the present embodiment, the dry distillation of the wastes A in the dry distillation furnace 2*b* is immediately started without shifting to the standby state in the case where the temperature Tc in the combustion furnace 4 decreases to the temperature $T_2$, the combustion unit 25 is ignited, and the temperature Td in the dry distillation furnace 2*a* decreases to a third predetermined temperature $Td_2$ (e.g. a temperature that is lower than the maximum temperature $Td_1$ by 10° C.) and then the temperature Tc in the combustion furnace 4 recovers the first set temperature $T_1$ at time $t_{11}$. When the dry distillation of the wastes A in the dry distillation furnace 2*b* is started, the combustible gas is produced by the dry distillation and the introduction of the combustible gas into the combustion furnace 4 is started.

Thus, the second aspect of the dry distillation gasification waste incineration method according to the present embodiment makes it possible to smoothly switch the combustible gas to be burnt in the combustion furnace 4 from the combustible gas produced in the dry distillation furnace 2*a* to the combustible gas produced in the dry distillation furnace 2*b*.

Figure 4:
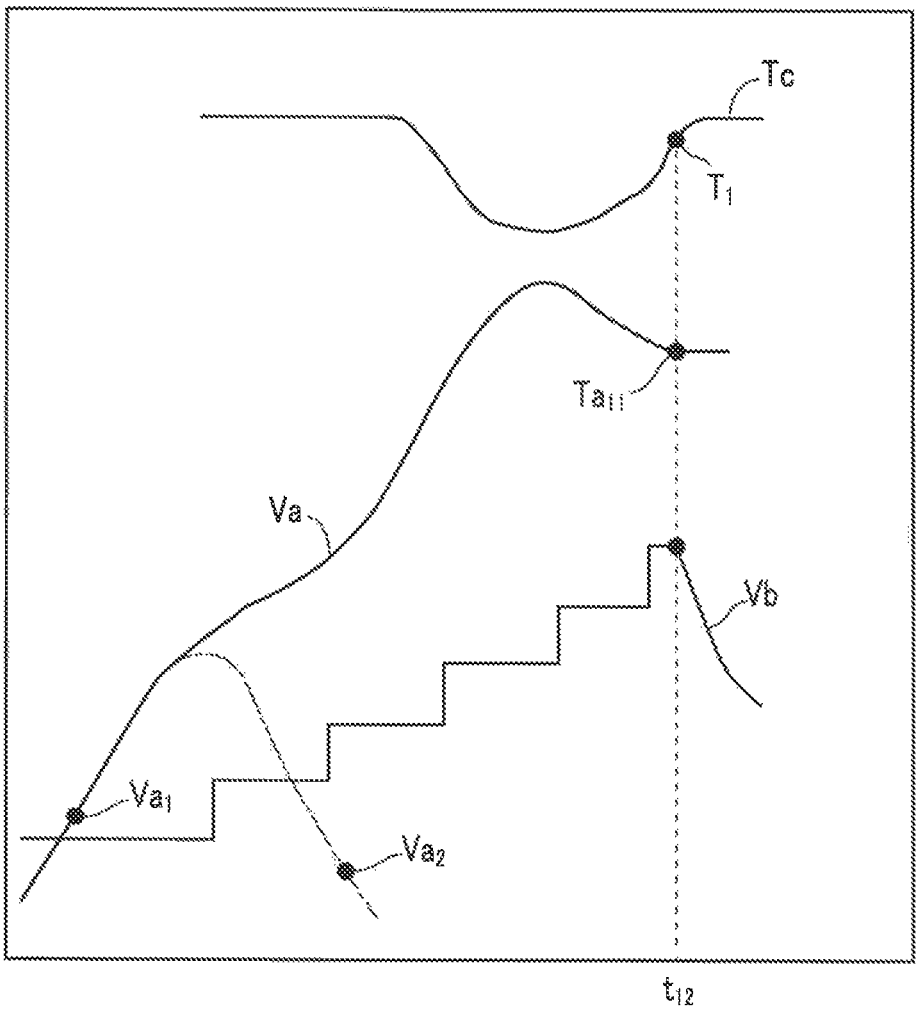
FIG. 4 is a graph illustrating the temporal changes in the temperature in a combustion furnace and the degrees of opening of the valves provided in a first and a second oxygen supply passages in a third aspect of the switching operation.

Referring now to FIG. 4, a description will be given of a third aspect of the dry distillation gasification waste incineration method according to the present embodiment using a dry distillation gasification incineration apparatus 1.

In the dry distillation gasification incineration apparatus 1, the operation for igniting the wastes A in the dry distillation furnace 2*b* can be performed by the controller 15 actuating the ignition unit 16*b* when the degree of opening Va of the control valve 13*a* in the dry distillation furnace 2*a* reaches the first predetermined degree of opening $Va_1$, as described above. Further, the operation for forming a fire bed in the wastes A in the dry distillation furnace 2*b* can be performed by the controller 15 controlling the valve drive 14*b* to increase the opening Vb of the control valve 13*b* in steps, as described above.

However, depending on the timing of the ignition of the wastes A in the dry distillation furnace 2*b*, there are some cases where, during the process of forming the fire bed, the wastes A that can produce the combustible gas in the dry distillation furnace 2*a* decrease, and the degree of opening Va of the control valve 13*a* gradually increases in order to control the temperature Tc in the combustion furnace 4 to the first set temperature Tc.

In this case, after exceeding the first predetermined degree of opening $Va_1$, the degree of opening Va of the control valve 13*a* continues to increase without decreasing to become the degree of opening $Va_2$, and then decreases to reach a predetermined degree of opening $Va_{11}$, which is larger than the first predetermined degree of opening $Va_1$. Further, at this time, the temperature Tc in the combustion furnace 4 temporarily decreases and then recovers the first set temperature $T_1$ due to an increase in the degree of opening of the control valve 13*a*, i.e. an increase in the combustible gas produced in the dry distillation furnace 2*a*.

Therefore, in the third aspect of the dry distillation gasification waste incineration method according to the present embodiment, the dry distillation of the wastes A in the dry distillation furnace 2*b* is immediately started without shifting to the standby state in the case where the degree of opening Va of the control valve 13*a* continues to increase without decreasing to become the degree of opening $Va_2$ after exceeding $Va_1$, and then decreases to reach the degree of opening $Va_{11}$, which is larger than the degree of opening $Va_1$, whereas the temperature Tc in the combustion furnace 4 temporarily decreases and then recovers the first set temperature $T_1$. When the dry distillation of the wastes A in the dry distillation furnace 2*b* is started, the combustible gas is produced by the dry distillation and the introduction of the combustible gas into the combustion furnace 4 is started.

Thus, the third aspect of the dry distillation gasification waste incineration method according to the present embodiment makes it possible to smoothly switch the combustible gas to be burnt in the combustion furnace 4 from the combustible gas produced in the dry distillation furnace 2*a* to the combustible gas produced in the dry distillation furnace 2*b*.

Further, according to the dry distillation gasification waste incineration method according to the present embodiment, the switching of the combustible gas to be burnt in the combustion furnace 4 from the combustible gas produced in the dry distillation furnace 2*b* to the combustible gas produced in the dry distillation furnace 2*a* can be performed in the same manner as that for switching from the combustible gas produced in the dry distillation furnace 2*a* to the combustible gas produced in the dry distillation furnace 2*b*. Hence, the dry distillation gasification waste incineration method according to the present embodiment makes it possible to continuously operate the dry distillation gasification incineration apparatus 1 by alternately repeating the dry distillation of the wastes A in the two dry distillation furnaces 2*a*, 2*b* for the single combustion furnace 4.

Further, in the dry distillation gasification waste incineration method according to the present embodiment, the valve drives 14*a*, 14*b* are controlled by the single controller 15. Alternatively, however, a plurality of controllers may be provided to separately control the valve drives 14*a*, 14*b*.

DESCRIPTION OF REFERENCE NUMERALS

1 . . . Dry distillation gasification incineration apparatus; 2*a*, 2*b* . . . Dry distillation furnace; 4 . . . Combustion furnace; 10*a*, 10*b* . . . Oxygen supply passage; 12 . . . Oxygen supply source; 15 . . . Controller; and A . . . Wastes.

The invention claimed is:

1. A dry distillation gasification waste incineration method in which a plurality of dry distillation furnaces are provided for one combustion furnace, wastes held in each of the dry distillation furnaces are sequentially dry-distilled thereby to produce a combustible gas, and control is carried out such that a temperature in the combustion furnace becomes a predetermined first temperature in a case where the combustible gas is introduced into the combustion furnace and burnt, the method comprising:

a step of supplying oxygen required for the dry distillation of the wastes to a first dry distillation furnace while controlling a degree of opening of a first valve provided in a first oxygen supply passage such that the temperature in the combustion furnace becomes the first temperature by the combustion of the combustible gas in a case where the combustible gas is produced by dry-distilling wastes held in the first dry distillation furnace by using the oxygen supplied to the first dry distillation furnace through the first oxygen supply passage from an oxygen supply source, and the combustible gas is introduced into the combustion furnace and burnt;

a step of detecting presence of wastes in a second dry distillation furnace after the temperature in the combustion furnace becomes the first temperature by the combustion of the combustible gas produced in the first dry distillation furnace and then igniting the wastes held in the second dry distillation furnace by using oxygen supplied to the second dry distillation furnace through a second oxygen supply passage from the oxygen supply source; and a step of dry-distilling the wastes held in the second dry distillation furnace by using oxygen supplied to the second dry distillation furnace through the second oxygen supply passage from the oxygen supply source so as to produce the combustible gas and then introducing the combustible gas produced in the second dry distillation furnace into the combustion furnace to start combustion, wherein the dry distillation gasification waste incineration method further comprises:

a step of forming a fire bed by controlling a degree of opening of a second valve in a case where the degree of opening of the first valve reaches a first predetermined degree of opening;

a step of decreasing the degree of opening of the second valve and supplying a sufficient amount of oxygen required to maintain the fire bed to the second dry distillation furnace through the second oxygen supply passage from the oxygen supply source in a case where, after the fire bed is formed, the degree of opening of the first valve increases beyond the first predetermined degree of opening, and then decreases until reaching a second predetermined degree of opening which is smaller than the first predetermined degree of opening; and a step of increasing the degree of opening of the second valve to dry-distill the wastes held in the second dry distillation furnace so as to produce the combustible gas by using the oxygen supplied to the second dry distillation furnace through the second oxygen supply passage from the oxygen supply source and to start the introduction of the combustible gas, which has been produced in the second dry distillation furnace, into the combustion furnace, in a case where the degree of opening of the first valve increases again until reaching a third predetermined degree of opening, which is larger than the second predetermined degree of opening, while control is being carried out such that the temperature in the combustion furnace becomes the first temperature by the combustion of the combustible gas produced in the first dry distillation furnace.

2. The dry distillation gasification waste incineration method according to claim 1, comprising a step of supplying oxygen required for the dry distillation of the wastes to the second dry distillation furnace while controlling the degree of opening of the second valve provided in the second oxygen supply passage such that the temperature in the combustion furnace becomes the first temperature by the combustion of the combustible gas in the case where the combustible gas, which has been produced in the second dry distillation furnace, is introduced into the combustion furnace and burnt.

3. The dry distillation gasification waste incineration method according to claim 1, wherein the degree of opening of the first valve or the second valve is locked at a predetermined degree of opening in a case where the temperature in the combustion furnace reaches a fourth predetermined temperature, which is higher than the first temperature, and the locking of the degree of opening of the first valve or the second valve is released in a case where the temperature in the combustion furnace reaches a temperature below the fourth predetermined temperature.

4. The dry distillation gasification waste incineration method according to claim 1, wherein two units of the dry distillation furnace are provided for one unit of the combustion furnace.

5. The dry distillation gasification waste incineration method according to claim 4, comprising a step of loading new wastes in the first dry distillation furnace after removing the wastes that have been ashed in the first dry distillation furnace from the first dry distillation furnace in the case where the wastes held in the second dry distillation furnace are subjected to dry distillation, wherein the dry distillation of the wastes in the first dry distillation furnace and the dry distillation of the wastes in the second dry distillation furnace are alternately repeated.

* * * * *